United States Patent [19]

Launt

[11] 3,949,334

[45] Apr. 6, 1976

[54] COMPACT REED SWITCH RELAY

[75] Inventor: Larry L. Launt, Livonia, N.Y.

[73] Assignee: Cunningham Corporation, Honeoye Falls, N.Y.

[22] Filed: Apr. 21, 1975

[21] Appl. No.: 569,913

[52] U.S. Cl. ..... 335/153; 335/177; 335/183

[51] Int. Cl.[2] ..... H01H 51/27

[58] Field of Search ..... 335/151, 152, 153, 154, 335/177, 183, 79, 266, 267, 268

[56] References Cited

UNITED STATES PATENTS

| | | | |
|---|---|---|---|
| 3,056,868 | 10/1962 | Jacobson et al. | 335/177 |
| 3,775,712 | 11/1973 | Launt | 335/153 |

*Primary Examiner*—Harold Broome

[57] ABSTRACT

A remarkably compact reed-switch relay having a U-shaped core comprised of two separate areas of remanent magnetic material and controlled by a first coil encircling the bight of the core and by a second coil encircling both legs of the core. Reed switches are positioned within the second coil and in proximity to the legs of the core, the switches being disposed with their magnetic axes substantially parallel to the core legs so that energization of the first coil causes orientation of the remanent core flux in a manner opening the switches and latching them open, while energization of the second coil closes the switches and orients the remanent core flux to latch them closed.

13 Claims, 4 Drawing Figures

COMPACT REED SWITCH RELAY

This invention relates to reed switch relays and, more particularly, to such relays of the magnetic latching type in which magnetically-responsive reed switches are disposed in proximity to a core of remanent magnetic material.

BACKGROUND

This invention is an improvement over the type of reed switch relay disclosed in my earlier U.S. Pat. No. 3,775,712 in which reed switches are disposed across the legs of a U-shaped or H-shaped core of remanent magnetic material. According to that prior art patent, two controlling coils are wound about the bight portions of the core, the first coil having its axis parallel to the bight, and the second coil being wound about the bight with its axis parallel to the legs of the U. When the coil having its axis parallel to the bight is energized, the core is magnetized as a simple horseshoe magnet with the flux gap extending between the legs and through the reed switches, closing the switches. When, however, the second coil is energized, the core becomes magnetized as a simple bar magnet and the core legs share the same magnetic polarity, thereby placing the same polarity on both reed elements of each switch causing them to open and holding them open.

The remanent magnetic materials used for the core are well known in the art and are characterized by the retention of a substantial amount of magnetism after removal of the magnetizing force. Further, these materials exhibit at least two stable remanent magnetization states and can be "flipped" from one state to the other by relatively short pulses of energizing currents. In my previously-patented structure just described above, the energization of the first coil drives the core legs to one stable remanent magnetization state, closing the switches and holding them closed, while energization of the second coil drives one core leg to its opposite stable magnetization state, opening the switches and holding them open.

The positive latching characteristics of my previously-patented structure are a great advantage. However, this prior art structure is difficult to shield from stray magnetic and electrical fields, and the structure lacks compactness, a matter of great importance in relation to both the physical size of switching arrays into which it is incorporated and, more importantly to the critical matter of the length of electrical circuit paths if very high frequencies are to be transmitted through the relay.

BRIEF DESCRIPTION

The improved relay disclosed herein retains the prior art advantages of (*a*) magnetic latching and (*b*) two-coil control in which either coil can be operated by simple pulses whose magnitude is not critical so long as it has sufficient value and duration to saturate the core of the relay to one of its bi-stable states. In addition, the structure disclosed herein (*c*) is readily shielded from stray fields, (*c*) provides more efficient magnetic coupling between its control coils and the core, (*e*) is remarkably compact, permitting an increase of as much as ten times as many relay units within the same switching-matrix area as that required by prior art reed relay switches and, along with this higher switch density, (*f*) can be used to switch signals above 20 MHz.

In the preferred embodiment of the invention, a U-shaped core is formed by two separate pieces of remanent magnetic material, each piece providing one leg and one-half of the bight of the U. The bight end of each core piece is narrowed considerably to provide a relatively high reluctance path. A first coil is wound about the bight of the U with its axis parallel to the bight, while a second coil encircles both legs of the U, the axis of this second coil being parallel to the legs. Reed switches are placed within the second coil and in proximity to the legs of the U-shaped core, the switches being disposed with their magnetic axes substantially parallel to the core legs.

When the coil encircling the bight of the core is energized by an appropriate pulse, the core is magnetized as a simple horseshoe magnet having a flux path with one polarity in one leg and the opposite polarity in the other leg. Each leg thereby induces the same magnetic polarity on both reed elements of its respective switch, causing the switch to open and remain open. However, whenever an energizing pulse is applied to the second coil which surrounds the legs of the core, the legs become, in effect, two simple bar magnets separated by the high reluctance path which divides the two halves of the core. Each bar magnet then induces magnetic fields of opposite polarity in the reed elements of its respective switch, causing the switch to close and to remain closed.

The preferred embodiment includes appropriate current-modifying elements (e.g., diodes or resistive matching pads) as required to prevent degradation of high frequency signals, and these elements along with the reed switches, coils and core, are all packaged together in a compact relay module (approximately one-half inch square and less than one inch high) covered by appropriate metallic material for shielding from stray electrical and magnetic fields.

DETAILED DESCRIPTION

The preferred embodiment of the invention will now be described in detail with reference being made to the accompanying drawings in which.

Figure 1:
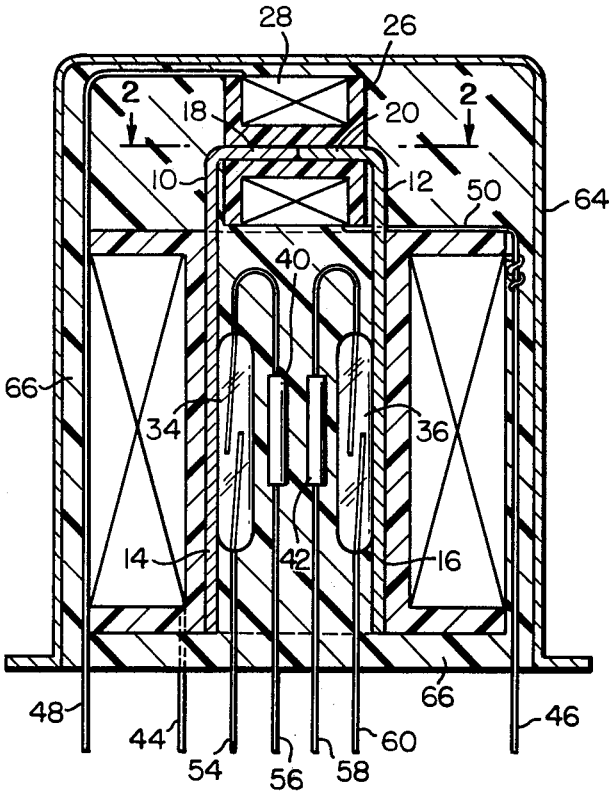
FIG. 1 is a cross-sectional view of a preferred embodiment of relay device according to the invention.
Figure 2:
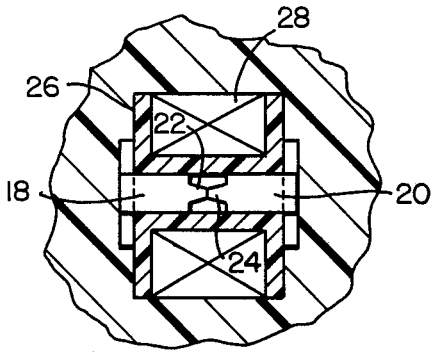
FIG. 2 is a cross-sectional view of a portion of the device shown in FIG. 1, taken along the line 2—2.

Referring first to FIGS. 1 and 2, the central portion of the relay comprises a U-shaped core of remanent magnetic material made up of two core members 10 and 12, each having a respective leg portion 14, 16 and a bight portion 18, 20. The bight end of each core member is narrowed to a nipple-like protrusion 22, 24. This narrowed portion of the core provides a relatively high reluctance path for magnetic flux carried by the core.

A non-metallic and non-magnetic bobbin 26 carries a first coil 28 and fits tightly about the bight portions 18, 20 of core members 10, 12, holding the core members with protrusions 22, 24 in contact with each other to form, in effect, a U-shaped core of remanent magnetic material.

A second non-metallic and non-magnetic bobbin 30 carrying a second coil 32 encircles core legs 14, 16. A pair of encapsulated reed switches 34, 36 are disposed in proximity, respectively, to core legs 14, 16, the magnetic axes of the switches being aligned substantially parallel thereto. It should be noted that, in this preferred embodiment, the reed switches and the legs of the U-shaped core are positioned inside of bobbin 30 and coil 32. Further, current-modifying elements 40, 42 in series, respectively, with the reed switches are also positioned within coil 32. The current-modifying elements may be resistive matching pads, diodes, or some other impedance device which, as will be appreciated by those skilled in the art, may be appropriate to prevent the degradation of high frequency signals due to attenuation by waves reflected along the transmission lines within the switching unit into which the illustrated device might be incorporated.

Pulses of energizing current are furnished to coil 32 through input lead 44, the circuit being completed from the coil through ground wire 46. Similarly, coil 28 is energized through pulses carried by input lead 48, the circuit being completed through ground wires 50 and 46.

Circuit connections to reed switches 34, 36 are made through respective circuit leads 54, 56, 58, and 60. It should be noted that all of the electrical leads for providing external connection to the relay unit are disposed in a parallel relationship, extending from the same end of the unit to permit simple plug-in connection. In the preferred embodiment, all of the electrical leads are aligned generally parallel to the legs of the U-shaped core.

The entire unit is enclosed in a cover 64 which preferably includes a metallic material to shield the entire device from stray electrical and magnetic fields. Finally, the entire unit is potted (e.g., in epoxy resin) to minimize the effects of moisture and vibration.

Figure 3:
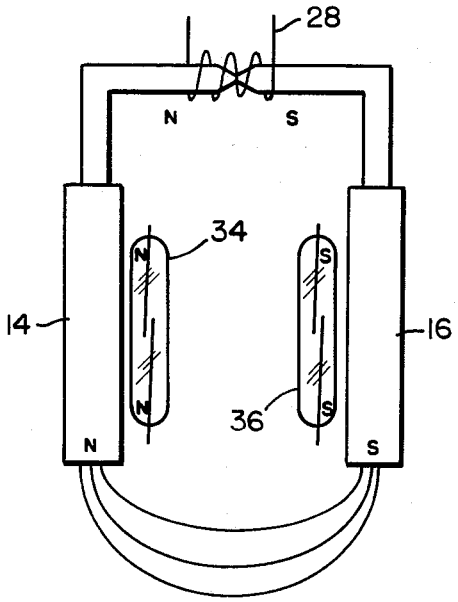
FIG. 3 is a schematic representation of the magnetic field induced in the core and reed switch elements following energization of the coil encircling the bight of the core.
Figure 4:
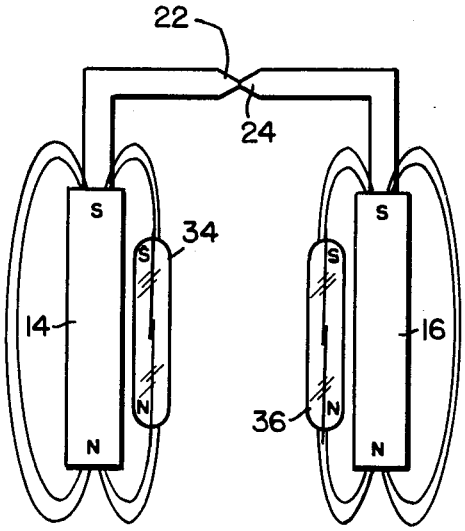
FIG. 4 is a schematic representation of the magnetic fields induced in the core members and the reed switch elements in response to energization of the coil encircling the legs of the core.

To latch the switches in an open condition, an energizing pulse is delivered to coil 28 to magnetize the U-shaped core as a simple horseshoe magnet with the flux primarily retained within the legs and bight of the core except for that portion of the flux which extends between the legs of the magnet. As illustrated schematically in FIG. 3, under this state of magnetization the reed elements of respective switches 34, 36 are induced with the same magnetic polarity, causing them to be repulsed to their open positions. While the magnetic fields induced into the reed elements nearest the bight are relatively light (as compared to the switch-closing fields referred to below), they are sufficient to effectively "latch" the reeds in their open position.

To latch the reed switches closed, coil 32 is energized, and each leg 14, 16 of the magnetic core acts as an independent bar magnet, this independence being greatly enhanced by virtue of the high reluctance path provided by the narrow protrusions 22, 24, at the center of the bight. This results in relatively strong magnetic fields of opposite polarity being induced in the reed elements of switches 34, 36, causing these elements to attract. Again, by virtue of the nature of the remanent magnetic material used in the core members, a substantial amount of the magnetism is retained after the energizing pulse has been removed, effectively latching the reed switch elements in their closed positions. This condition continues until an unlatching pulse is delivered to coil 28, causing the magnetic fields retained in the remanent magnetic core to resume the condition illustrated in FIG. 3.

The simple relay design described above is relatively simple and inexpensive to manufacture, and the unique coil arrangements result in particularly efficient coupling between the energizing coils and the remanent magnetic core. Further, this inexpensive and efficient design can be constructed in a remarkably small format, namely, in a shielded plug-in module measuring less than one-half inch square and less than 1 inch high, making it possible to form a reed switch switching-matrix array of 800 cross points within the same area which prior art relay designs could provide only 50 cross points.

What is claimed is:

1. An electromagnetic relay comprising:

a U-shaped core of remanent magnetic material in the form of two legs interconnected by a bight;

a first energizing coil encircling the bight of said core;

a second energizing coil encircling both legs of said core; and a reed switch disposed in proximity to at least one of said legs with its magnetic axis substantially parallel thereto.

2. The relay of claim 1 wherein the bight of said core includes a high-reluctance portion.

3. The relay of claim 1 wherein said core comprises two separate members, each member forming one leg and a portion of the bight.

4. The relay of claim 2 wherein said high-reluctance path comprises a narrowed portion of said bight.

5. The relay of claim 3 wherein the bight end of each core member has high reluctance relative to other portions of the core.

6. The relay of claim 5 wherein each said bight end is narrower than other portions of the core.

7. The relay of claim 1 wherein said first and second coils share a common lead.

8. The relay of claim 1 wherein at least one other reed switch is disposed in proximity to the other core leg with its magnetic axis substantially parallel thereto.

9. The relay of claim 1 further comprising a current-modifying element in series connection with said reed switch.

10. The relay of claim 1 further comprising a plurality of electrical lead means for providing external electrical connections, respectively, to said coils and to the switch elements of said reed switch, all of said lead means being disposed in parallel relationship.

11. The relay of claim 10 wherein said electrical lead means are further disposed parallel to said core legs.

12. The relay of claim 1 further comprising cover means adapted to enclose said core, coils and switch.

13. The relay of claim 12 wherein said cover means comprises an appropriate metallic member for electrically and magnetically shielding said enclosed relay elements.

* * * * *